US008943971B1

(12) United States Patent
Sherlock et al.

(10) Patent No.: US 8,943,971 B1
(45) Date of Patent: Feb. 3, 2015

(54) COMPOUNDED HIGH EXPLOSIVE COMPOSITES FOR IMPACT MITIGATION

(75) Inventors: Mary H. Sherlock, Waldorf, MD (US); Lori Nock, La Plata, MD (US); Raafat Guirguis, Fairfax, VA (US); Wade Babcock, Waldorf, MD (US); Harold Sandusky, Fulton, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 232 days.

(21) Appl. No.: 13/507,873

(22) Filed: Aug. 3, 2012

(51) Int. Cl.
*F42B 12/20* (2006.01)

(52) U.S. Cl.
USPC ..... 102/478; 102/481

(58) Field of Classification Search
USPC ..... 102/473, 478, 481, 283, 285, 288, 289, 102/290, 293, 292, 332
See application file for complete search history.

(56) References Cited

U.S. PATENT DOCUMENTS

| | | | | | |
|---|---|---|---|---|---|
| 382,223 | A * | 5/1888 | Graydon | ..... | 102/478 |
| 382,224 | A * | 5/1888 | Graydon | ..... | 102/478 |
| 382,225 | A * | 5/1888 | Graydon | ..... | 102/478 |
| 382,226 | A * | 5/1888 | Graydon | ..... | 102/478 |
| 382,228 | A * | 5/1888 | Graydon | ..... | 102/478 |
| 382,229 | A * | 5/1888 | Graydon | ..... | 102/478 |
| 3,757,694 | A * | 9/1973 | Talley et al. | ..... | 102/495 |
| 3,960,085 | A * | 6/1976 | Abernathy et al. | ..... | 102/492 |
| 5,024,159 | A | 6/1991 | Walley | | |
| 5,267,513 | A * | 12/1993 | Guirguis et al. | ..... | 102/475 |
| 5,467,714 | A | 11/1995 | Lund et al. | | |
| 7,278,356 | B1 * | 10/2007 | Geisler et al. | ..... | 102/364 |
| 7,624,682 | B2 | 12/2009 | Lloyd | | |
| 7,717,042 | B2 | 5/2010 | Lloyd | | |
| 7,895,947 | B1 * | 3/2011 | Sutherland et al. | ..... | 102/254 |
| 8,256,350 | B2 * | 9/2012 | Haskins | ..... | 102/478 |
| 2005/0230018 | A1 | 10/2005 | Viecelli et al. | | |
| 2006/0037509 | A1 * | 2/2006 | Kneisl | ..... | 102/355 |
| 2007/0006766 | A1 | 1/2007 | Kellner | | |
| 2008/0202373 | A1 | 8/2008 | Hugus et al. | | |
| 2010/0236443 | A1 * | 9/2010 | Haskins | ..... | 102/478 |
| 2010/0282115 | A1 | 11/2010 | Sheridan et al. | | |
| 2011/0203475 | A1 * | 8/2011 | Thuman | ..... | 102/275.11 |

* cited by examiner

*Primary Examiner* — Jonathan C Weber
(74) *Attorney, Agent, or Firm* — Fredric J. Zimmerman

(57) ABSTRACT

Compounded High Explosive Composites provide a novel family of low-cost explosives that exhibit anisotropic (directionally dependent, non-symmetric) sensitivity properties to replace current homogenous plastic bonded high explosives that are vulnerable to unwanted detonation from a variety of hazards and operating conditions. Anisotropic sensitivity behavior is largely achieved by manipulating the bulk property of critical diameter to fine-tune the compounded geometry of the explosive composite. As such, Compounded High Explosive Composites represent structural arrangements of small, spatially distributed, highly consolidated explosive units (pellets) arranged in a prescribed (but versatile) fashion in a motion and energy-dampening rubbery matrix. The compounded geometry and structural arrangement allows the explosive pellets to function cooperatively and detonate in an exemplary orientation, while ensuring the pellets do not cooperate in other directions to mitigate against known vulnerabilities and threats.

24 Claims, 6 Drawing Sheets

COMPOUNDED HIGH EXPLOSIVE COMPOSITES FOR IMPACT MITIGATION

STATEMENT OF GOVERNMENT INTEREST

The present invention described herein may be manufactured and used by or for the Government of the United States of America for government purposes without the payment of any royalties thereon or therefore.

FIELD OF THE INVENTION

The present invention relates generally to conventional high explosive (HE) systems and methods. More particularly, the present invention relates to a compounded high explosive composite that includes a structurally assembled approach of heterogeneous materials consisting of patterned assemblies of small, highly consolidated high explosive sub-units (pellets) arranged and spatially distributed and encapsulated in a motion and energy dampening rubbery matrix to form a new family of energetic materials with anisotropic (directionally dependent, non-symmetric) sensitivity properties called compounded HE composites.

BACKGROUND OF THE INVENTION

Referring to FIG. 1, a diagram illustrates an exemplary missile 10 with known vulnerability of radial (side) impacts attributed to environmental unplanned stimuli and combat hazards such as stray bullets and fragments. The missile 10 includes a fin 12, a propulsion section 14, a control section 16, an armament (warhead) section 18, and a guidance section 20. Additionally, the armament (warhead) section of some ordnance is susceptible to premature detonation from operating conditions such as axial launch setback loads and weapon penetration failure modes.

A detonation is, by definition, a wave that propagates "ignition" from one point to the next, not a bulk process that uniformly acts on the high explosive material. Conventional plastic bonded high explosives (PBX) used in the (warhead) section 18, typically consist of homogeneously distributed solid energetic ingredients in a mitigating polymeric binder system. Established detonations in supercritical PBX charges can fail dynamically, for example when negotiating a divergent geometry. Dynamic failures are observed in converging conical charges, where a detonation initiated in the cylindrical section of the charge with a supercritical diameter may fail as it traverses a tapered section falling below the critical diameter of the explosive. Further, a steady detonation wave in an explosive can develop a region of zero or partial reaction (a dead zone) as it turns around a sharp corner. Thus, the spatial distribution of the energetic materials can make a huge difference on the behavior of the explosive.

BRIEF SUMMARY OF THE INVENTION

The current state of the art high explosives are vulnerable to premature detonation from a variety of environmental threats and operating conditions. These vulnerabilities can be mitigated with a new family of novel, spatially distributed, low cost explosives that exhibit anisotropic (directionally dependent, non-symmetric) sensitivity properties called compounded HE composites.

Compounded HE composites non-symmetric behavior is achieved by manipulating the properties and geometry of explosives to achieve anisotropic sensitivity. Compounded HE composites consist of small, highly consolidated explosive units arranged and encapsulated in a motion-dampening rubbery matrix. The simple, small HE sub-unit building blocks are assembled in geometric patterns to construct creative compounded HE composites warhead structures. When complete, the effective energy content of the Compounded HE composite structure is equivalent to a conventional plastic-bonded explosive (generally 82-88% energetic material solids by weight), but the detonation characteristics are completely different and controllable.

Generally, explosive charges may only sustain a detonation when their transverse dimensions are sufficiently large, also called critical thickness or critical diameter, as cylinders of explosives of various diameters are generally used to characterize this behavior. When the transverse dimension is subcritical, incipient detonations fail because of rarefactions that encroach upon the reaction zone. Compounded HE composites exploit this phenomenon through the use of spatially distributed structural arrangements, which allow the plurality of high explosive unit cells (aka sub-units and pellets) to function cooperatively to detonate the compounded HE composites in an exemplary orientation for warhead functioning. This occurs while ensuring the HE subunits do not cooperate in other directions (generally orthogonal (perpendicular) orientations) to mitigate against known vulnerabilities and threats.

The anisotropic (directionally dependent, non-symmetric) behavior of the compounded HE composites is largely achieved by fine-tuning the HE sub-unit geometry and proportions to the bulk properties of the high explosive formulation used. The properties of the high explosive cells and the damping properties and thickness of the matrix of mitigation material provides for control of the dynamic response of the compounded high explosive composite, and hence its failure modes and anisotropic sensitivity behavior.

In the exemplary embodiment shown in FIG. 1, where mitigation against radial (side) impacts attributed to environmental unplanned stimuli is desired, the compounded high explosive composite used in the armament section includes a plurality of unit HE cells (aka sub-units and pellets) each including a high explosive material. Each unit HE cell is dimensioned too small to sustain or propagate a detonation in a radial direction, whereas the plurality of unit HE cells are positioned in an arrangement to sustain or propagate a detonation in an axial direction.

In yet another exemplary embodiment, the missile or munition warhead includes a compounded high explosive composite including a plurality of unit HE cells each including a highly consolidated high explosive material. Each of the plurality of unit HE cells are dimensioned too small to mitigate, sustain or propagate a detonation in an axial direction, whereas the plurality of unit HE cells are positioned in an arrangement to sustain or propagate a detonation in a radial axial direction. Anisotropic (directionally dependent, non-symmetric) sensitivity properties are required in the axial direction to mitigate against premature warhead detonation from predominantly axial loads attributed to setback during launch, weapon target penetration failure modes, or the like.

In another exemplary embodiment, the unit HE cells each may include a substantially rectangular and cylindrical shape or a shape that provides for close packing configurations such as hexagonal, rosette, and circular brick-paver shaped configurations or the like. The compounded high explosive composite may further include mitigation materials disposed within the arrangement and further configured to mitigate against known vulnerabilities. The mitigation materials may include high-performing viscoelastic materials that are substantially inert or mildly energetic.

The arrangement may include a plurality of stacked layers of the unit HE cells. Each of the layers may be shifted relative to adjacent layers. The arrangement may include a plurality of stacked plates, each of the stacked plates includes a mosaic of the unit HE cells with interstitial voids filled with motion damping mitigation material. The compounded high explosive composite may further include a mitigation layer between each of the stacked plates. The stacked plates may be rotated relative to one another forming a staggered pattern of unit HE cells of high explosive. Additionally, the Plurality of unit HE cells each may include a variety of uniform and mixtures of geometries, including, but not limited to, a substantially hexagonal shape, a rosette shape, diamonds, tablets, triangles, ellipsoids, spheres, octagons, and mixtures of geometries as well as circular brick-paver arrangements. The plurality of unit HE cells may be manufactured as individual pressed explosive pellets in order to achieve a desired high solids filled explosive for the compounded high explosive composite.

In another exemplary embodiment, the plurality of unit HE cells may be formed from parallel twin-screw extruder (TSE) strands of high explosive with a method to bundle, adhere, and slice radially the bundled parallel twin screw extruder (TSE) strands to form a plurality of layers; and rotating one or more of the plurality of layers. The method may further include including mitigation materials between and within the plurality of layers

BRIEF DESCRIPTION OF THE DRAWINGS

The present invention is illustrated and described herein with reference to the various drawings, in which like reference numbers denote like system components, respectively, and in which.

DETAILED DESCRIPTION OF THE INVENTION

Figure 1:
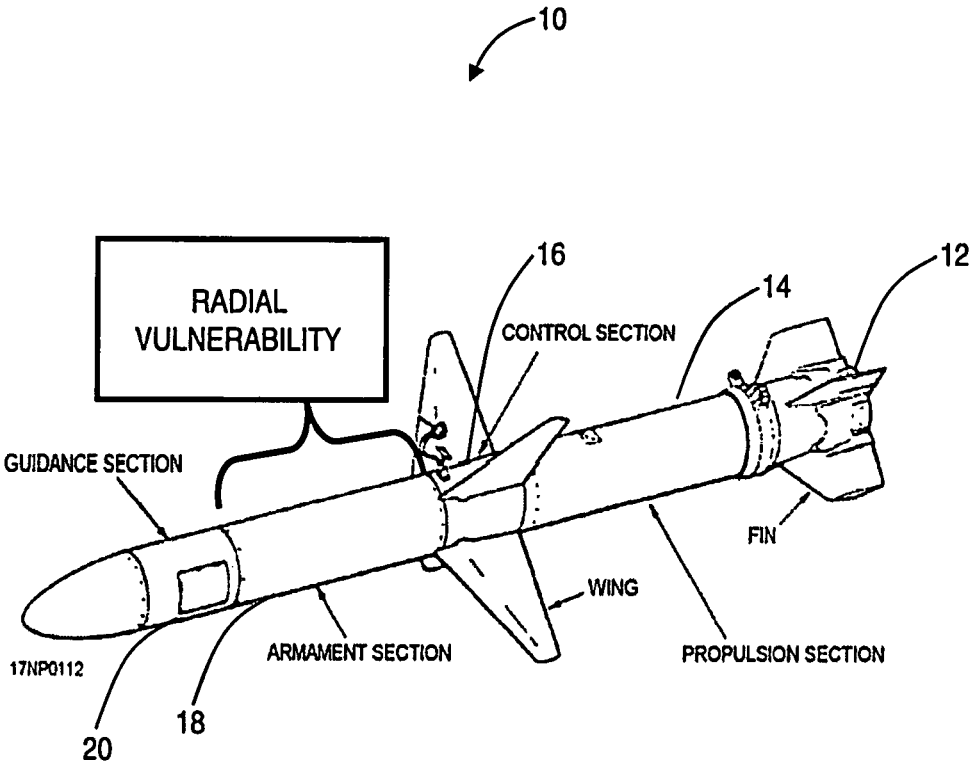
FIG. 1 (Prior Art)
FIG. 1 is a diagram of an exemplary missile with known vulnerability of radial (side) impacts attributed to unplanned stimuli.

In various exemplary embodiments, the present disclosure provides a compounded high explosive composite that includes a structurally assembled approach including mitigation layers surrounding highly consolidated, high solids filled high explosive pellets or units. These unit HE cells, arranged in careful geometric patterns, are assembled in a prescribed fashion, to construct creative warhead structures. Despite the variation in the design and purpose of individual pieces, they are all part of a universal system used to create intricate mosaic patterns of HE unit HE cells that are relatively simple to assemble and fabricate a compounded high explosive composite. The HE unit HE cells forming the compounded high explosive composite, by themselves, are too small to sustain or propagate a detonation in the direction of the known vulnerability.

This structurally assembled, spatially distributed, high explosive approach is referred to herein as compounded high explosive composites, and may be applied in bulk missile warheads to mitigate the vulnerability of inadvertent warhead detonation caused by unplanned stimuli from the mechanical impact threats in the combat environment, including stray bullets, and weapons effects like fragments and the like. Preferential geometry minimizes the cross sectional area (footprint) of the high explosive in the radial direction (for impact mitigation) and provides for the preferential placement of mitigation materials to reduce the energetic response from side radial impacts attributed to unplanned stimuli. Conversely, a large high explosive footprint in the axial direction ensures prompt detonation transfer from the warhead's explosive train.

The anisotropic sensitivity behavior of the compounded high explosive composite reduces the propensity of the high explosive to transition to detonation under threat impact conditions (fragment impact (FI), bullet impact (BI), shaped charge jet impact (SCJI), and sympathetic reaction (SR of adjacent munition stores)), by increasing the run distance to detonation in the radial direction (loading scenario for unplanned impact stimuli) while ensuring the warhead functions as designed (explosive train propagates a detonation). The compounded HE composite delivers similar performance as a homogeneous cast-cured polymer-bonded explosive (PBX) with an effective energetic solids of about 82-about 88% by weight. The compounded HE compound is a sustainable product using mature HE manufacturing technology including: the twin screw extruder (TSE), the rotary tablet press, the isostatic press or similar technologies used to manufacture the HE components.

Alternatively, in an exemplary embodiment, the arrangement may be manipulated to provide a compounded high explosive composite architecture that is orthogonally opposed to the high explosive superstructure previously described. In the orthogonally opposed compounded high explosive composite architecture embodiment, the cross sectional area (footprint) of the high explosive in the radial direction is maximized to ensure prompt detonation from an explosive booster train but minimized in the axial direction to reduce, greatly, the energetic response from longitudinal (axial) loads associated with vulnerability to premature detonation from launch setback loads, and weapon penetration failure modes.

Figure 2:
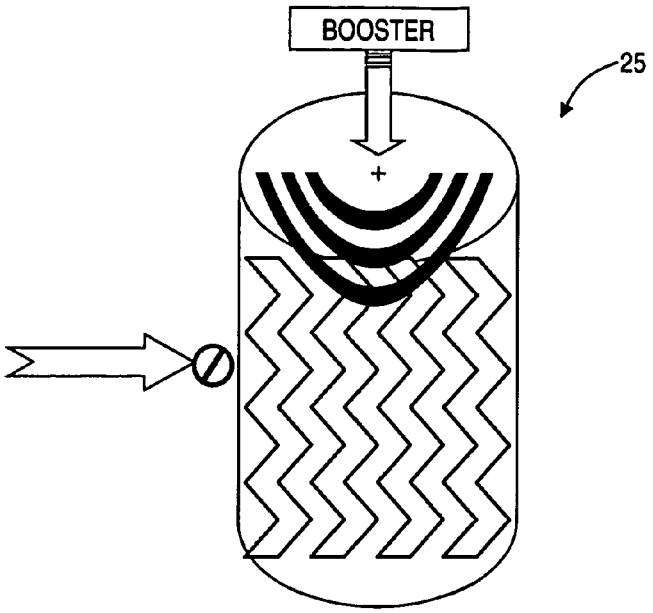
FIG. 2 is a diagram of a strategy for a compounded high explosive composite to optimize the warhead structure for axial detonation propagation and radial impact quenching.

Referring to FIG. 2, in an exemplary embodiment, a diagram illustrates a strategy for a compounded high explosive composite 25 in the armament section 18 of a missile to optimize structure for axial detonation propagation from the explosive train and radial impact quenching. The compounded high explosive composite 25 is a conceptual warhead structure preferentially providing a directionally sensitive structure for unprecedented control to allow for a steady state detonation of the high explosive along the warhead's boostering pathway to ensure proper warhead functioning, while providing an unstable configuration that disrupts and dissipates wave propagation from the known vulnerability, such as radial (side) impacts attributed to unplanned stimuli. The principles applied to achieve directional sensitivity in a warhead are the preferential spatial distribution of the energetic and mitigation materials to exploit dynamic high explosive detonation failure modes. The assembly of the high explosive sub-units into a superstructure is tuned such that spatio-temporal wave propagation relationships are either constructively or predictably preserved, as in the case of detonation by the explosive train and booster for proper warhead functioning, or intentionally destructively interfered in order to prevent detonation transfer from a known vulnerability such as a radial impact.

Figure 3:
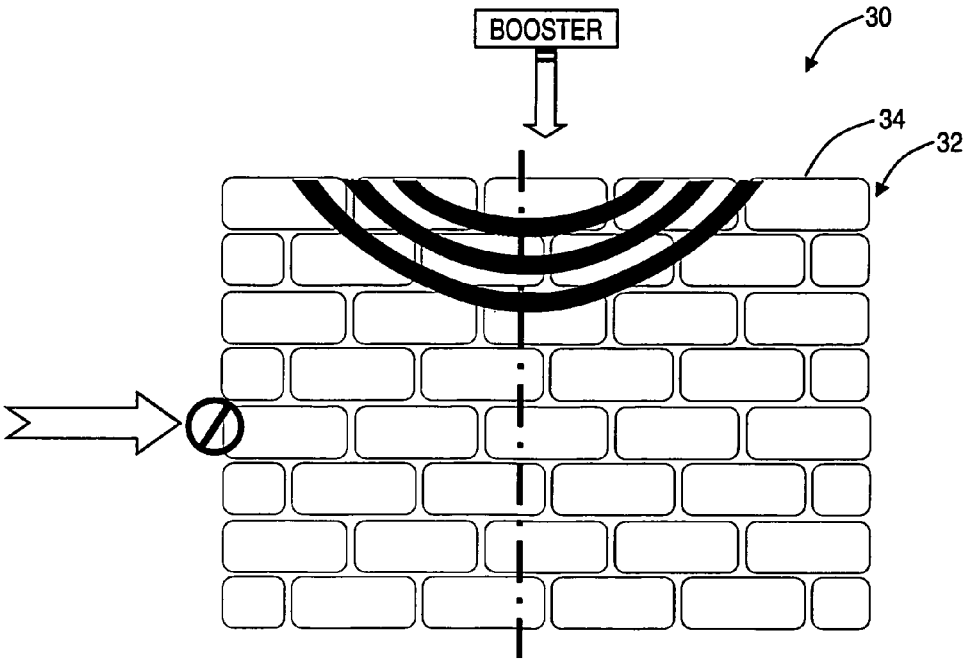
FIG. 3 is a diagram of a first exemplary structure for the compounded high explosive composite.
Figure 4:
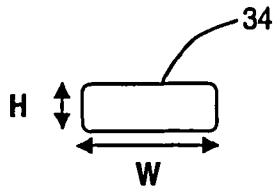
FIG. 4 is a diagram of a single unit cell of high explosive used to construct the compounded high explosive composite of FIG. 3 and provide the desired anisotropic (directionally dependent, non-symmetric) sensitivity properties of the compounded high explosive composite warhead system.

Referring to FIG. 3 and FIG. 4, in an exemplary embodiment, a single unit HE cell 34 used to construct the compounded high explosive composite 30 is illustrated. Note, a plurality of the unit HE cells 34 along with mitigation materials may be used to form the compounded high explosive composite 25 and 30. The unit HE cell 34 has a cross-sectional area represented by its height, H, and a cross sectional area represented by its width, W, and the scale of the unit HE cell 34 is related to the critical energy of the high explosive. The cross-sectional area represented by the height, H, of the discrete unit HE cell 34 is directly related to the critical diameter, $D_{cr}$, of the explosive formulation used to fabricate the HE unit cells. The critical diameter (aka failure diameter and failure thickness) is the minimum diameter or thickness in which the explosive can sustain a steady state detonation wave in a cylindrical charge regardless of the volume of explosive. In an exemplary embodiment, the cross-sectional area represented by the height, H, is less than the critical diameter, $D_{cr}$, i.e. $H<D_{cr}$, such that the height of the unit HE cell 34 is sub-critical. In an exemplary embodiment, the cross-sectional area represented by the width, W, of each of the unit HE cells 34 is near the critical diameter, $D_{cr}$, such that it can sustain a detonation, i.e. $W \sim D_{cr}$. In another exemplary embodiment, the cross-sectional area represented by the width, W, may be greater than the critical diameter, $D_{cr}$, for detonation, i.e. $W>D_{cr}$. In yet another exemplary embodiment, the cross-sectional area represented by the width, W, may be determined relative to input pressure and run distance. The spatially distributed, geometric arrangement containing multiple unit HE cells, 34, function cooperatively together to detonate the compounded HE composite in the exemplary orientation for warhead functioning (where the unit HE cell cross sectional geometry is supercritical, $>D_{cr}$), but the cells function uncooperatively to mitigate against known environmental threats and operational vulnerabilities in orthogonal orientations (where the unit HE cell cross sectional geometry is subcritical, $<D_{cr}$).

The geometric scaling of the single unit HE cell 34 geometry is key to setting up the desired anisotropic sensitivity properties of the compounded HE composite 25 and 30. For example, following an impact perpendicular to the cross-sectional area represented by the height, H, i.e. H<Dcr, the localization of energy in each sub-unit HE cell 34 and subsequent local perturbations in the neighboring, spatially distributed high explosive sub-units respond differently to disrupt the spatio-temporal relationships and create destructive wave interactions such that they do not coalesce in time or space to cooperate, run up, and transition to a detonation.

Figure 5:
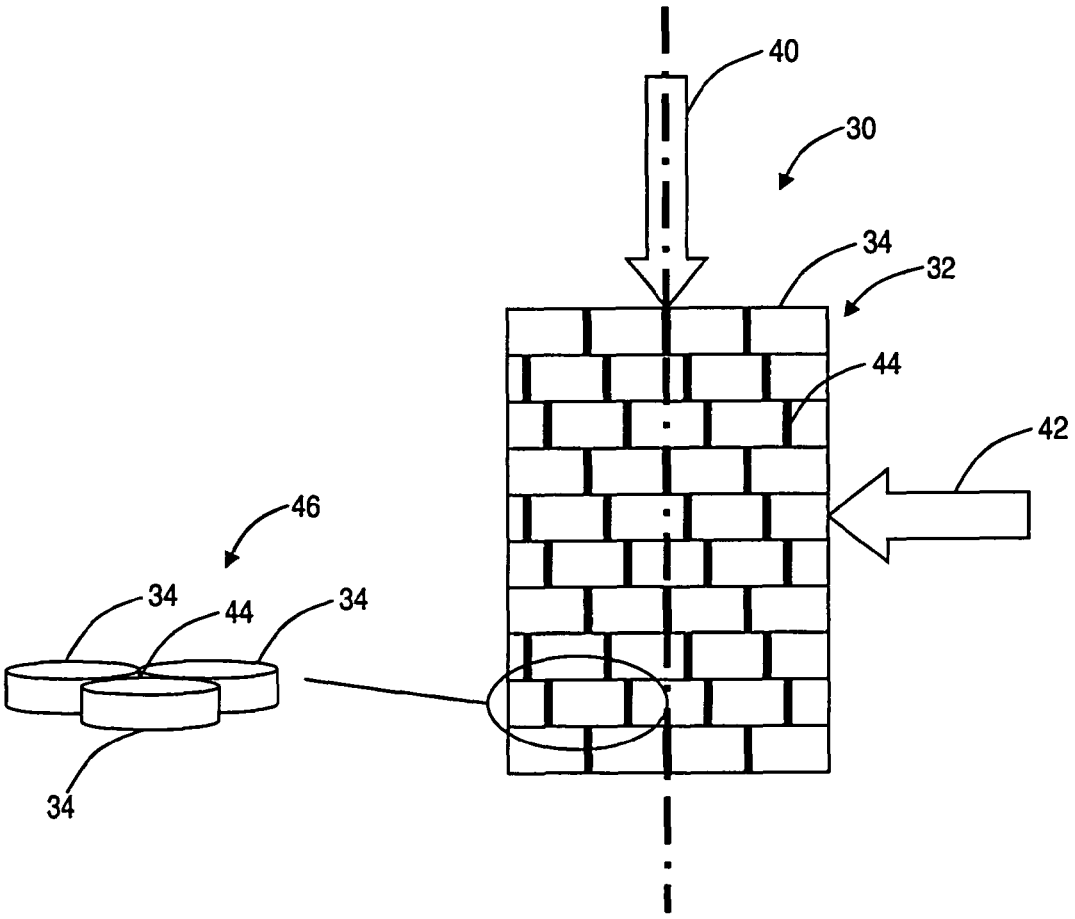
FIG. 5 is a diagram of the first exemplary structure with applied pressures and shocks.
Figure 6A:
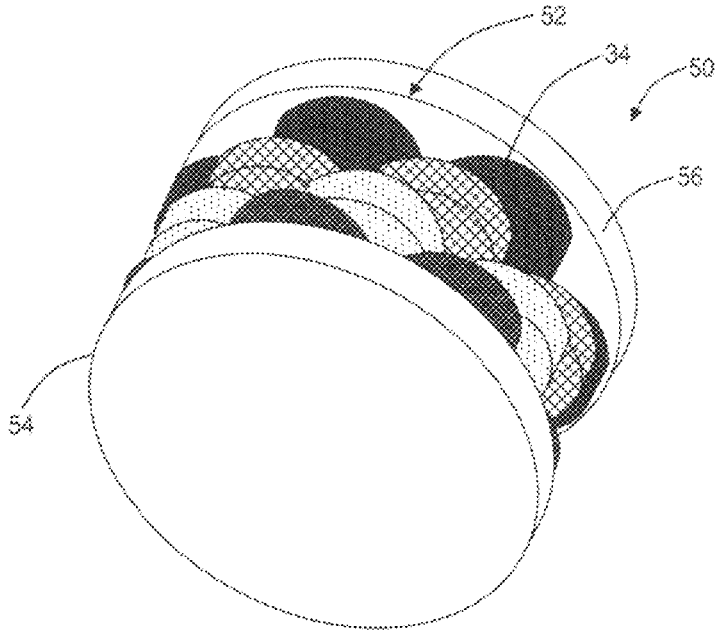
FIG. 6A is a perspective diagram of a second exemplary structure for the compounded high explosive composite.
Figure 6B:
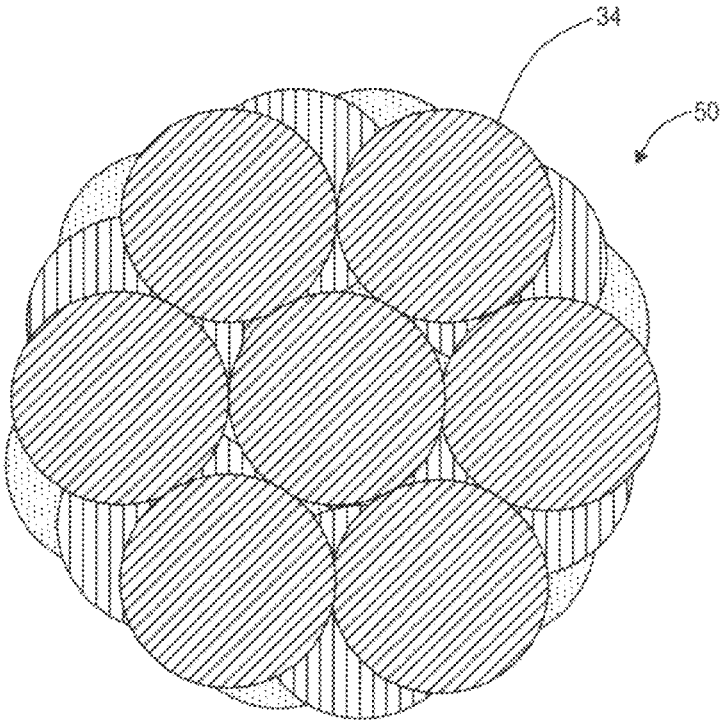
FIG. 6B is a cross-sectional diagram of the second exemplary structure.

Referring to FIG. 5, besides skewing the sub-unit high explosive cell geometry 34 to above or below the critical thickness of the bulk explosive to achieve anisotropic sensitivity and explosive response, mitigation materials 44 are placed around and between the high explosive unit HE cells 34 to further create spatio-temporal discontinuities in the advancing sub-critical wave fronts within the compounded composite superstructure 25 and 30. Consequently, these discontinuities cause a precipitous drop in the pressure at the lead reaction fronts leading to shock divergence and directional spreading. Instead of equally distributing a mitigating binder throughout a homogeneous bulk plastic bonded explosive (PBX), the mitigating material 44 is placed where it is needed most: to mitigate against known vulnerabilities and interfere with subsequent propagation. The unique spatially distributed HE geometry 30 and the deliberate placement of mitigation materials 44 plays an important role in wave dissipation and dispersion, where wave scattering is influenced by multiple reflections of internal interfaces between dissimilar materials along the most vulnerable wave propagation pathways (radial for impact mitigation; longitudinal for survivability from setback and penetrator loads).

The mitigation materials placed 44 around each high explosive unit HE cell 34 do not necessarily a represent conventional plastic bonded explosive binder systems. Rather, the mitigation layers are envisioned as high-performing viscoelastic materials that may be used to provide energy and motion damping for the sub-component HE unit HE cell structures. Additionally, the mitigation layers do not necessarily have to be inert. The mitigation layers may be binder-rich, highly insensitive explosive formulations (e.g., diluted explosive solids such as about 40- about 50% by weight explosive) where the critical threshold for ignition becomes difficult to achieve. Other combinations of mitigation materials are possible, including alternating HE sub units and layers of ideal and non-ideal explosives to disrupt the shock front emanating from the direction of the known vulnerability. The high explosive sub-units cells also may vary in size, scale, and explosive gradients.

Just as a basic building blocks are used to make a whole host of end assemblies, the unit HE cell 34 of the compounded high explosive composite 25 and 30 may be assembled and varied to create new warhead concepts. Referring to FIG. 3, in an exemplary embodiment, a first exemplary structure 30 is illustrated for the compounded high explosive composite 25. The exemplary structure 30 is formed by making "stacked plates" 32 of various unit HE cells 34. Parallel Twin Screw Extruder (TSE) strands may be assembled longitudinally using energy damping adhesive that flows through the long interstitial voids to form a column that may then be sliced radially to form a plate 32 and subsequently stacked in a rotated fashion with the additional of mitigation layers between the circular sheets. The result is an intricate mosaic pattern of HE unit cells that is relatively simple to make. Unexpected benefits arise from the method of fabrication, which includes plates 32 that are subsequently stacked in a staggered fashion with additional mitigation layer between the circular sheets. This configuration is described in FIGS. 6A-8B herein.

Referring to FIG. 5, in an exemplary embodiment, the first exemplary structure 30 is illustrated for the compounded high explosive composite 25 with applied axial shock 40 and radial shock 42. The exemplary structure 30 utilizes a construction that minimizes the cross sectional footprint of high explosives unit HE cells 34 in the radial direction and provides alternating high explosives unit HE cells and mitigation layers 44 along the radial propagation path and between layers. The compounded high explosive composite 25 in the first exemplary structure 30 (and other structures described herein) is designed such that the stimulus from the radial shock 42 cannot initiate detonation in a single discrete unit HE cell 34 radially.

The compounded high explosive composite 25 includes mitigation materials 44 surrounding the unit HE cells 34 that create discontinuities between the unit HE cells 34, separating the radial shock 42 and causing a precipitous drop in the pressure at the lead reaction front. For illustration, an exploded view 46 illustrates three exemplary units HE cells 34 in a particular plate 32. As shown therein, the mitigation material 44 is disposed between and around the unit HE cells 34. Further, in this exemplary embodiment, the unit HE cells 34 are illustrated with a cylindrical geometry for illustration purposes. Closed-packed geometries, such as hexagonal arrangements that form honeycomb plates more generally to increase the effective explosives load in the compounded high explosive composite 25 and 30.

Accordingly, based on the dimensioning of the unit HE cells 34, the positioning of the unit HE cells 34 in the compounded high explosive composite 25, and the mitigation materials 44 used therein, a shock required for radial initiation 42 is much greater than a shock required for axial detonation 40, thus establishes the anisotropic sensitivity characteristics. When the compounded high explosive composite 25 is subjected to a radial impact event, the initiation process is governed by the pressure of the developed compressive wave front and the distance (and time) that the wave passes through the explosive material before transitioning into a full detonation. This distance is known as the run-to-detonation distance. In general, the lower the pressure of the compressive pressure wave, the longer the run distance.

In various exemplary embodiments, the unit HE cell 34 scaling is such that the impact stimulus in the direction of the known vulnerability is too weak to initiate detonation in a single discrete cell 34. The mitigation material 44 creates discontinuities between the cells 34, and also separates the wave front and causes a precipitous drop in the pressure at the lead reaction front. Whereas in a PBX, a rubbery matrix is homogeneously distributed with the solid high explosive and energetic ingredients, the energy and motion damping rubbery matrix of the compounded high explosive composite 25 and 30, is heterogeneously distributed where it is needed most to complement the anisotropic sensitivity behavior and to further mitigate against side impact events 42 and subsequent radial propagation of the wave front.

For example, the first exemplary structure 30 illustrated in FIG. 5 the high explosive content of the HE unit cells 34 is about 91% to about 98% by weight high explosive (or other energetic ingredients), depending on the HE manufacturing method used to produce the HE unit cells. When assembled in the rubbery mitigation matrix, the effective energy content of the resulting Compounded HE composite mimics that of an about 82% to about 88% effective solids filled plastic-bonded explosive. The embodiments using pressed pellets for the unit HE cells 34 increases the solids loading of the unit HE cells 34 and allow for more mitigation material 44 to surround the unit HE cells 34 when compared to unit HE cells produced by extrusion methods.

Figure 7A:
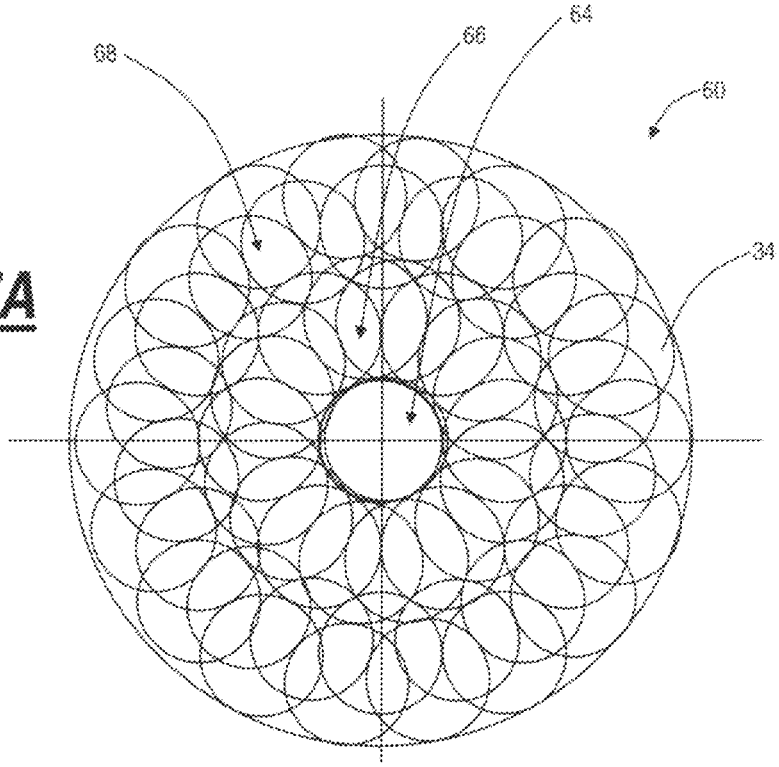
FIG. 7A is a cross-sectional diagram of a third exemplary structure for the compounded high explosive composite.
Figure 7B:
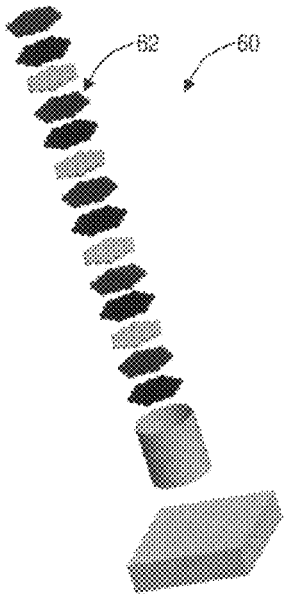
FIG. 7B is a perspective diagram of the third exemplary structure.

Referring to FIGS. 7A and 7B, in an exemplary embodiment, a cross-sectional diagram (FIG. 7A) and a perspective diagram (FIG. 7B) illustrate a third exemplary structure 60 for the compounded high explosive composite 25. The third exemplary structure 60 includes nineteen units HE cells 34 per layer 62 in a closely packed array. Similar to the second exemplary structure 50, the unit HE cells 34 in the third exemplary structure 60 include a cylindrical geometry. The third exemplary structure 60 includes a single unit HE cell 34 disposed in a center region 64, six unit HE cells 34 disposed around the center region 64 in an intermediate region 66, and twelve unit HE cells 34 disposed around the intermediate region 66 in an outer region 68. FIG. 7B illustrates three exemplary layers 62 via highlighting of the unit HE cells 34 differently for each of the layers 62. In an exemplary embodiment as illustrated in FIG. 7B, the third exemplary structure 60 may include a plurality of layers 62 comprised of an array of unit HE cells 34, such as, for example 12-16. In an exemplary embodiment, the third exemplary structure 60 may include a rotation between adjacent layers such that a pattern repeats at a distinct number of layers. For example, using an approximate 20 degree offset between adjacent layers, the pattern will repeat every fourth layer. In an exemplary embodiment, voids between the units HE cells 34 may be filled with a mitigating rubber surround. In addition, there may not be mitigation materials between adjacent layers 62.

Figure 8A:
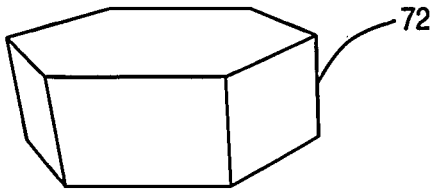
FIG. 8A is a perspective diagram of a fourth exemplary structure using a hexagonally shaped unit HE cell for the compounded high explosive composite.
Figure 8B:
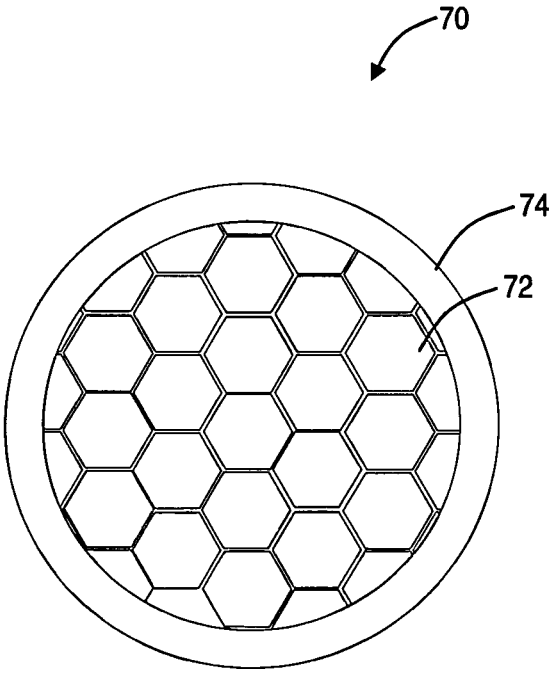
FIG. 8B is a cross-sectional diagram of the fourth exemplary structure.

Referring to FIGS. 8A and 8B, in an exemplary embodiment, a perspective diagram (FIG. 8A) and a cross-sectional diagram (FIG. 8B) illustrate a fourth exemplary structure 70 using a hexagonally shaped unit HE cell 72 for the compounded high explosive composite 25. The fourth exemplary structure 70 may be formed through stacked honeycomb plates 74 formed using the hexagonally shaped unit HE cells 72. The honeycomb plates 74 may be formed by having a plurality of parallel hexagon rods assembled longitudinally using an energy-damping adhesive as the mitigation material that flows through long interstitial voids to form a charge that can be sliced radially. The resulting honeycomb plates 74 may be subsequently stacked in a rotated fashion relative to adjacent plates 74 with an additional binder layer between the plates 74. Thus, the fourth exemplary structure 70 includes an intricate mosaic tile pattern that is relatively simple to manufacture. Hexagonal geometries for the HE unit HE cell 34 that form honeycomb plates are generally more likely and increase the effective explosives load in the compounded high explosive composite 25 and 30.

In addition to the unit HE cells 34 and the hexagonally shaped unit HE cells 72, the present disclosure contemplates various additional geometries for the unit HE cells forming the compounded high explosive composite 25. These structures may include, but not limited to: rectangular shaped unit HE cells, rosette shaped unit HE cells, tablet shaped unit HE cells, and circular brick-paver shaped configuration. The unit HE cells may be made using TSE strands, rods, or extruded shapes from pressed HE billets, tablets, pellets and other geometries. Further, the present disclosure also contemplates various additional mechanisms to form the compounded high explosive composite 25. For example, box shaped or rectangular shaped unit HE cells may form a diagonal tile pattern with mitigation materials there between, rippled chips of co-layered stacked plates may be formed, patterns can be machined within each HE unit HE cell 34, layer 62 and the like.

As described herein, unit HE cell density may include high solids filled HE unit HE cells (91-98% by weight) fabricated using various manufacturing technologies (pressed, extruded). Trade-offs are achieved by using high solids fill unit HE cells 34 and 72 that decrease the binder volume within unit cell while increasing the volume for the mitigating material surround 44 to achieve a explosive (energetic) performance equivalent to about 82%- about 88% by weight solids filled PBX.

With respect to unit HE cell 34 scales, the critical diameter and run-to-detonation distances can be manipulated and increased by using insensitive high explosive ingredients such as TATB (triaminotrinitrobenzene) or NTO (3-nitro-1, 2,4-triazol-5-one). NTO has a relatively large critical diameter and high insensitivity compared to conventional explosive ingredients such as cyclotrimethylene trinitramine (RDX) or cyclotetramethylenetetranitramine (HMX)), and TNT. The unit HE cells 34 and 72 may include different high explosive ingredients, co-layered explosives, perforations in cells (discontinuities), etc., and other combinations of mitigation materials, including alternating layers (co-layered) of ideal and non-ideal explosives to disrupt the shock front emanating for unplanned stimuli. Further, the plurality of unit HE cells (super structure) may be non-uniform in shape and composition. In addition, each unit HE cell may also be non-uniform in shape and composition relative to another unit HE cell. Further, mitigation materials may be used that provide additional damping compared to conventional polymeric binder systems used in PBX to prevent hot spot pile up. There is also potential to use dirty binders as a potential mitigation layer to further increase explosive solids fill content, but provide dispersion and spatiotemporal divergent wave propagation needed between unit HE cells in the direction of know vulnerabilities and threats.

Lastly, the compounded HE composite architecture described herein, 30, 50, 60, and 70, for use as a main charge explosive for armament and warhead sections of ordnance can also be employed as a booster used in an explosive train. Boosters are generally considered the Achilles Heel for vulnerability to unplanned stimuli; if a stimulus from the external environment impacts a booster, it generally detonates and can proceed to detonate the main charge explosive. Examples of unplanned hazard include bullets and stray fragments traveling at high velocities that may impact with sufficient energy to cause the booster explosive contained inside a munition to undergo a violent reaction. In a configuration similar to that described in FIG. 6B, the booster has the same benefits as a main explosive charge using the compounded HE composite architecture. It is detonable along the prescribed axis, but its anisotropic sensitivity properties are used to mitigate against unplanned stimuli from the environment (natural or combat induced) being able to impact the booster and propagate a full detonation of the booster. As such, compounded HE composite technology may be used in an explosive booster to ensure the proper detonation of the main explosive charge of a warhead and armament by design, while being significantly less vulnerable to external hazards and threats that may cause a partial reaction of compounded HE composite boosters following an unplanned event that generally would fail to detonate the main charge explosive.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

Although the present invention has been illustrated and described herein with reference to exemplary embodiments and specific examples thereof, it will be readily apparent to those of ordinary skill in the art that other embodiments and examples may perform similar functions and/or achieve like anisotropic (directionally dependent, non-symmetric) sensitivity properties characteristics and results. All such equivalent embodiments and examples are within the spirit and scope of the present invention and are intended to be covered by the following claims.

What is claimed is:

1. A compounded high explosive composite having anisotropic sensitivity properties comprising:

a plurality of unit cells comprising a high explosive material, wherein each of the plurality of unit cells are dimensioned too small to sustain a detonation in a first cross-sectional area, wherein the plurality of unit cells are positioned in an arrangement to propagate and sustain a detonation in a second cross sectional area, which is orthogonal to the first cross-sectional area, wherein the arrangement comprises a plurality of stacked plates, and wherein each of the plurality of stacked plates is comprised of said plurality of unit cells to achieve anisotropic sensitivity properties of a high explosive super structure.

2. The compounded high explosive composite of claim 1, wherein each of the plurality of unit cells are dimensioned too small to sustain a detonation in the radial direction, and wherein the plurality of unit cells are positioned in an arrangement to propagate and sustain a detonation in an axial direction.

3. The compounded high explosive composite of claim 2, further comprising mitigation material filling interstitial boundaries among the plurality of unit cells.

4. The compounded high explosive composite of claim 2, further comprising mitigation material filling interstitial boundaries among the plurality of unit cells, wherein the mitigation materials comprise energy and motion damping viscoelastic materials.

5. The compounded high explosive composite of claim 2, further comprising mitigation material filling interstitial boundaries among the plurality of unit cell, wherein the arrangement comprises a plurality of stacked plates, wherein each of the plurality of stacked plates comprises the plurality of unit cells, and wherein a mitigation layer is present between each of the plurality of stacked plates.

6. The compounded high explosive composite of claim 2, further comprising mitigation material filling interstitial boundaries among the plurality of unit cell, wherein the arrangement comprises a plurality of stacked plates, wherein each of the plurality of stacked plates comprises the plurality of unit cells, and wherein the plurality of stacked plates are rotated relative to one another to form a mosaic pattern.

7. A missile armament warhead, comprising a structure of claim 2, wherein the missile armament warhead includes anisotropic sensitivity properties to mitigate against premature detonation.

8. The compounded high explosive composite of claim 1, wherein each of the plurality of unit cells are dimensioned too small to sustain or propagate a detonation in the axial direction, and wherein the plurality of unit cells are positioned in an arrangement to sustain or propagate a detonation in a radial direction.

9. The compounded high explosive composite of claim 8, further comprising mitigation material filling interstitial boundaries among the plurality of unit cells.

10. The compounded high explosive composite of claim 8, further comprising mitigation material filling interstitial boundaries among the plurality of unit cells, wherein the mitigation materials comprise energy and motion damping viscoelastic materials.

11. The compounded high explosive composite of claim 8, further comprising mitigation material filling interstitial boundaries among the plurality of unit cell, wherein the arrangement comprises a plurality of stacked plates, wherein each of the plurality of stacked plates comprises the plurality of unit cells, and wherein a mitigation layer is present between each of the plurality of stacked plates.

12. The compounded high explosive composite of claim 8, further comprising mitigation material filling interstitial boundaries among the plurality of unit cell, wherein the arrangement comprises a plurality of stacked plates, wherein each of the plurality of stacked plates comprises the plurality of unit cells, and wherein the plurality of stacked plates are rotated relative to one another to form a mosaic pattern.

13. A warhead armament, comprising a structure according to claim 8, wherein said warhead armament includes properties to mitigate against premature detonation from axial launch setback loads and axial target penetration failure modes.

14. The compounded high explosive composite of claim 1, wherein each of the plurality of unit cells comprises a geometry comprised of varying geometries to maximize packing densities, and wherein said each of the plurality of unit cells comprises a close packing configuration, which includes at least one of cylindrical, rectangular, hexagonal, rosette, and circular paver shaped configuration.

15. The compounded high explosive composite of claim 1, wherein each of the plurality of unit cells comprises a geometry comprised of varying geometries to maximize packing densities, and wherein the geometry includes a cross-sectional area less than a critical diameter of the high explosive material in a direction of known vulnerability.

16. The compounded high explosive composite of claim 1, wherein each of the plurality of unit cells comprises a geometry comprised of varying geometries to maximize packing densities, and wherein the geometry is comprised of a cross-sectional area at least equal to a critical diameter of the high explosive material that forms in a direction for favorable detonation from an explosive train of at least one of an armament and a warhead.

17. The compounded high explosive composite of claim 1, wherein the arrangement comprises a plurality of layers of the plurality of the unit cells.

18. The compounded high explosive composite of claim 17, wherein each of the plurality of the layers is shifted relative to adjacent layers, and wherein each of said unit cells comprise a non-uniform shape and composition relative to other said unit cells.

19. The compounded high explosive composite of claim 1, wherein the plurality of unit cells are formed from strands of high explosive material assembled parallel to each other.

20. The compounded high explosive composite of claim 1, wherein the plurality of unit cells are pressed or isostatic pressed pellets of said high explosive materials, and wherein the plurality of unit cells are comprised of varying shapes and composition.

21. The compounded high explosive composite of claim 1 being used as a main charger explosive in an armament and warhead section of a munition.

22. The compounded high explosive composite of claim 1 being used as a booster explosive in the explosive train section of an armament and warhead section of a munition.

23. An ordnance, comprising: a conventional booster explosive being replaced with compounded high explosive composites of claim 1.

24. A compounded high explosive composite having anisotropic sensitivity properties, comprising:

a plurality of unit cells comprising a high explosive material, wherein each of the plurality of unit cells are dimensioned too small to sustain a detonation in a first cross-sectional area, wherein the plurality of unit cells are positioned in an arrangement to propagate and sustain a detonation in a second cross-sectional area, which is orthogonal to the first cross-sectional area, wherein the arrangement comprises a plurality of stacked plates, wherein each of the plurality of stacked plates is comprised of said plurality of unit cells to achieve anisotropic sensitivity properties of a high explosive super structure, and wherein the plurality of cells form the high explosive superstructure capable of being initiated by a conventional explosive booster train.

* * * * *